United States Patent [19]

Versaci

[11] Patent Number: 4,913,284

[45] Date of Patent: Apr. 3, 1990

[54] METHOD AND PACKAGE FOR AUTHENTICATION OF FIRST DAY OF ISSUE ROLLS OF POSTAGE STAMPS

[76] Inventor: Antonio A. Versaci, 2528 Peters La., Schenectady, N.Y. 12309

[21] Appl. No.: 241,704

[22] Filed: Sep. 8, 1988

[51] Int. Cl.[4] ..... B65D 67/00

[52] U.S. Cl. ..... 206/232; 206/410; 206/807; 53/415; 101/483

[58] Field of Search ..... 383/5; 206/389, 232, 206/807, 225; 283/58, 81, 57, 59; 101/483

[56] References Cited

U.S. PATENT DOCUMENTS

| | | | |
|---|---|---|---|
| 675,766 | 6/1901 | Black | 383/68 |
| 3,933,304 | 1/1976 | Judd | 206/807 |
| 4,483,018 | 11/1984 | Whelan | 383/5 |
| 4,549,658 | 10/1985 | Sfikas | 206/807 |
| 4,641,578 | 2/1987 | Versaci | 101/483 |
| 4,720,040 | 1/1988 | Gurewitz | 383/5 |
| 4,807,806 | 2/1989 | Neiman | 206/232 |

*Primary Examiner*—Clifford D. Crowder

*Attorney, Agent, or Firm*—Charles W. Helzer

[57] ABSTRACT

A method for the first day of issue authentication of rolls of original stamps wherein each stamp in the roll is attached to its neighbor by interconnected, perforated edges that form an integral roll of stamps. The roll of stamps to be authenticated is enclosed in an outer, flexible, clear plastic container that is sealed closed after insertion of the roll of stamps. A printing ink sensitive label is secured over the exterior of the closed end of the container in a manner to assure that the container has not been opened after insertion of the roll of stamps, closure and adherence of the label. The label has a stamp removed from the roll, or a similar stamp of the same issue, secured to it and has stamped thereon the First Day of Issue cancellation seal including a bull's eye containing the date and name of the post office performing the authentication, the First Day of Issue notice and at least a portion of the killer bar cancellation segments with at least the terminal ends of the killer bar cancellation segments impinging upon and cancelling the stamp attached to the end of the label.

19 Claims, 2 Drawing Sheets

Fig. 3
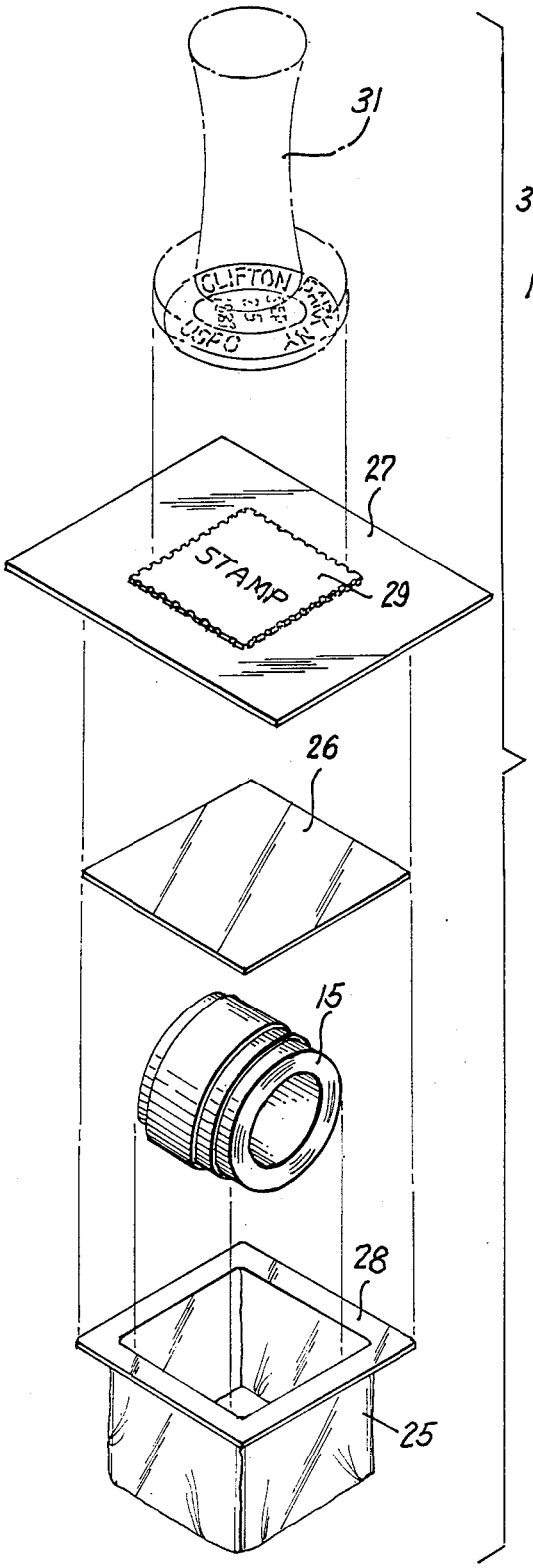
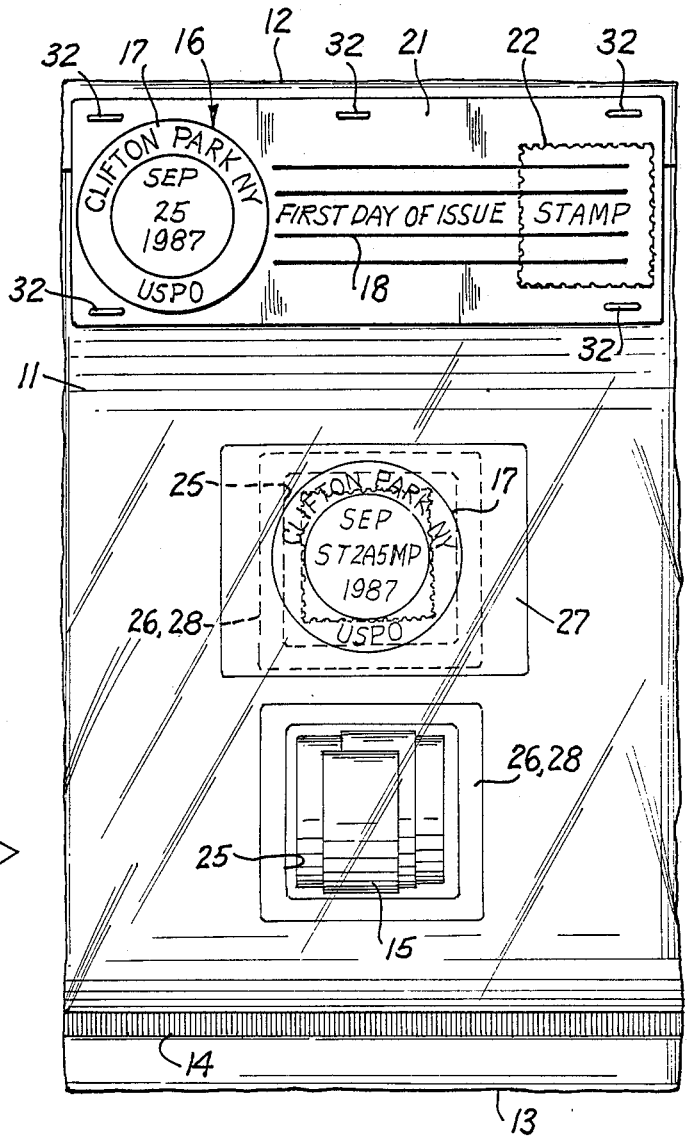
Fig. 4

METHOD AND PACKAGE FOR AUTHENTICATION OF FIRST DAY OF ISSUE ROLLS OF POSTAGE STAMPS

TECHNICAL FIELD

This invention relates to the practice of authentication of United States or other postal system postage stamps on the first day of issue of a new stamp.

In particular, the invention relates to a novel method and package for use in the authentication of rolls of new stamps on the first day of issue of such rolls of new stamps by the application of an authenticating first day of issue cancellation seal to the exterior of a container for such rolls of newly issued postage stamps.

BACKGROUND OF INVENTION

The United States postal system as well as many foreign postal systems cancel postage applied to envelopes, post cards and various other stationery or parcel post objects, by applying a cancellation seal to the postage stamp affixed to the envelope. The cancellation seal usually is applied by a hand stamp or by machine stamp cancelling devices. To be thus cancelled, it is a requirement by law that the postage stamp being cancelled, be affixed to the exterior of an envelope, post card, etc. and that the cancellation seal bearing a bull's eye portion that contains both the date and the name of the post office doing the cancellation, be impressed upon the stamp being cancelled.

In cases where a new series of stamps is being issued, because of the demand by stamp collectors, the post office on the first day of issue of the new series of stamps will apply a special seal containing a First Day of Issue notice in the cancellation seal. This special First Day of Issue cancellation seal includes not only a bull's eye portion having the date and name of the post office thereon together with a killer bar cancellation segment, but also includes the First Day of Issue notice. The killer bar cancellation segment of the seal normally produces a quantity of parallel wavy lines that extend to and over a stamp being cancelled.

U.S. Pat. No. 4,641,578 issued Feb. 10, 1987 for a "Method and Device for Authentication of First Day of Issue Stamps" describes and claims a method and suitable envelope for the First Day of Issue authentication of sheets or panels (sometimes referred to as panes) of postage stamps having a selvage edge on the sheet of the stamps to which the First Day of Issue notice and cancellation seal is applied.

SUMMARY OF INVENTION

The present invention provides a method and package for the easy authentication of rolls of postage stamps on the first day of issue as presently practiced.

It is a principle object of the present invention to provide a novel method and package for use in the authentication of new rolls of postage stamps on the first day of issue of such stamps.

In practicing the invention, a method for the First Day of Issue authentication of a roll of original government issue postage stamps which during printing are interconnected in an integral strip of individual stamps by means of perforated edge portions integrally interconnecting adjacent stamps in the roll. The method comprises enclosing a roll of stamps to be authenticated in an outer container and sealing closed the container with the roll of stamps inside. A printing ink sensitive label then is secured to the exterior of the closed container over the end of the container which has been opened in order to insert the roll of stamps and then sealed closed in a manner to assure that the container has not been opened after closure and authentication. The label is of sufficient length to accommodate the First Day of Issue cancellation seal of the US Postal System including a bull's eye containing date and name of the post office performing the authentication, the First Day of Issue notice and at least a portion of the killer bar cancellation segments. A stamp that has been removed from the roll to be authenticated, or another original stamp of the same issue, is then adhered to the label in a position to be struck by at least the terminal end of the killer bar cancellation segment whereby upon application of the First Day of Issue cancellation seal to the label at least the terminal ends of the killer bar cancellation segments of the cancellation seal impinge upon and cancel the original stamp adhered to the label secured over the closed end of the sealed container.

The container preferably comprises a transparent, flexible plastic bag that can be opened and then permanently sealed closed after the insertion of the roll of stamps to be authenticated. If desired, a plurality of rolls of stamps of the same issue can be inserted into the container prior to sealing it closed.

In another embodiment of the invention, the roll or stamps to be authenticated first is inserted into an individual, relatively rigid, closed inner container of clear plastic material for protection of the authenticated roll of stamps during subsequent handling with the inner container and enclosed roll or stamps thereafter being inserted into the first-mentioned outer container bearing the First Day of Issue cancellation seal. Further, a second stamp removed from the roll of stamps to be authenticated, or another original stamp of the same issue, is adhered onto a second label secured over a removable top of the inner container of relatively rigid clear plastic material. The second stamp is cancelled with at least the bull's eye containing the date and name of the post office performing the authentication prior to inserting the inner container and enclosed roll of stamps to be authenticated into the outer, flexible plastic container to which the First Day of Issue cancellation seal is applied.

BRIEF DESCRIPTION OF DRAWINGS

These and other objects, features and many of the attendant advantages of this invention will be appreciated from a reading of the following detailed description, when considered in connection with the accompanying drawings, wherein like parts in each of the several figures are identified by the same reference characters, and wherein:

FIG. 3 is an exploded, partial perspective view of a relatively rigid, clear plastic inner container used to support a roll of stamps to be authenticated in an outer flexible container, and shows how a stamp to be cancelled is applied to the movable top of the inner, relatively rigid, container; and FIG. 4 is a front plan view of another embodiment of the invention wherein staples are used to permanently seal closed the top of the outer flexible container and secure the cancellation label to the closed end of the outer container.

BEST MODE OF PRACTICING THE INVENTION

Figure 1:
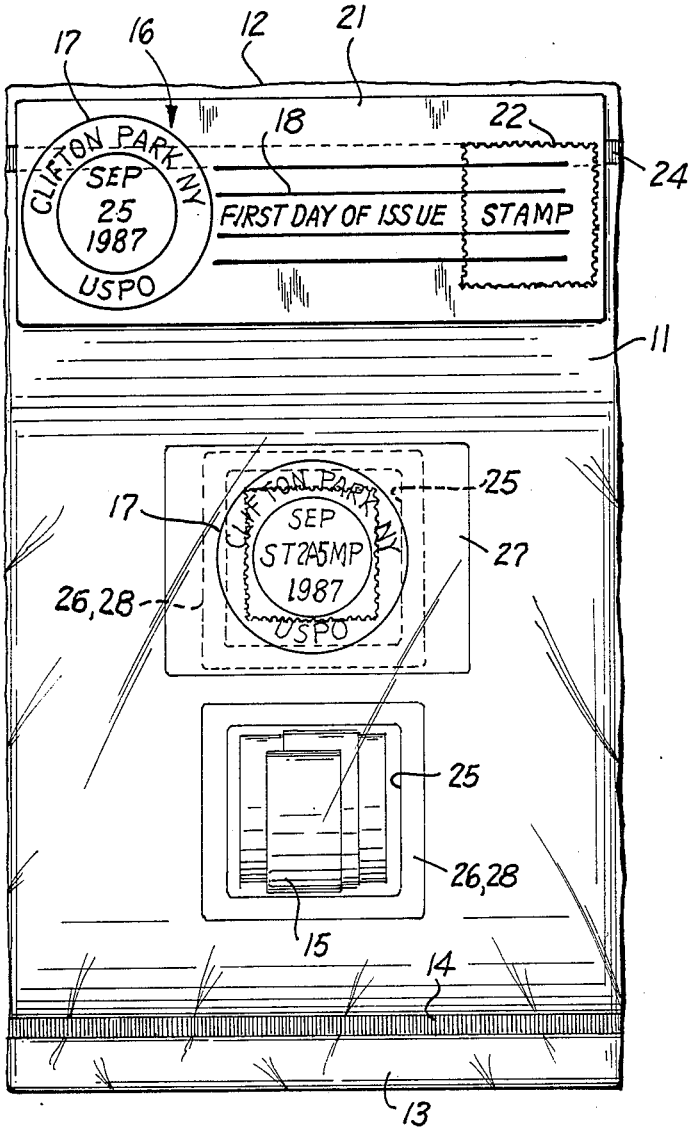
FIG. 1 is a front side plan view of a First Day of Issue authenticated roll of postage stamps package illustrating one embodiment of the invention wherein an adhesively applied label is employed to seal closed the packaged roll of stamps.
Figure 2:
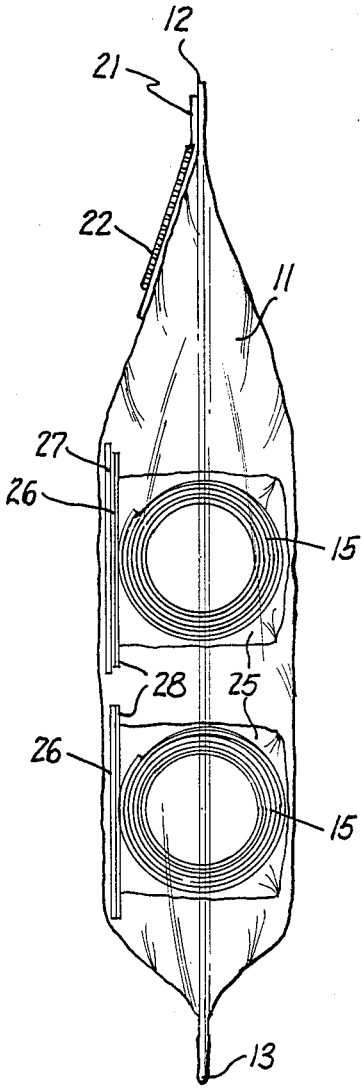
FIG. 2 is a side view of the embodiment of the invention shown in FIG. 1.

Rolls of United States postage stamps normally are provided with some 100, or more, individual stamps in a roll wherein each stamp in the roll is interconnected to its neighbors by a perforated edge portion that integrally interconnects each stamp to all of the other stamps in the roll which likewise has integrally interconnected perforated edge portions. It is this characteristic of rolls of stamps which allows an entire roll of stamps to be authenticated as first day of issue stamps by use of the present invention. This is accomplished by enclosing one or more rolls of stamps to be authenticated in an outer, flexible, clear plastic container 11 in the form of a bag as shown in FIGS. 1, 2 and 4 of the drawings. The outer container bag 11 has an upper end 12 that can be opened in order to insert objects within the container and a lower end 13 that is permanently sealed closed by a bottom seal 14.

One or more rolls, shown at 15 in FIG. 2, of a new issue of United States postage stamps are purchased from a United States Post Office which has been designated by the Postal Service to sell the stamps on a "First Day of Issue" basis for a designated period of one day. Such a designated post office will employ a cancellation seal such as that shown at 16 in FIG. 1. The First Day of Issue cancellation seal 16 is comprised of three parts including a bull's eye portion 17 which lists the date of issue and name of the designated authenticating post office, a First Day of Issue notice portion 18 and a killer bar cancellation segment 19 that produces a plurality of parallel straight or wavy lines.

In the embodiment of the invention shown in FIGS. 1 and 2, the outer flexible plastic container bag 11 is provided with a gummed sticky label 21 that is sufficiently long to accommodate the full extent of the First Day of Issue cancellation seal. By design, the label 21 also accommodates an original stamp shown at 22 removed from the roll of stamps to be authenticated or alternatively, it may comprise another original stamp of the same issue. The stamp 22 is adhered to the end of the label 21 in a position such that the terminal ends 19 of the killer bar segments strike and cancel the stamp upon application of the First Day of Issue cancellation seal to the label.

In using the container package 11 while authenticating a first day of issue roll of stamps, the top end 12 of container 11 is opened and a roll of stamps to be authenticated is inserted in this outer flexible container bag 11. Container 11 then is permanently sealed closed by a seal 24 at its upper end similar to the permanent seal 14 applied to the lower end of the container. Following sealing of the upper end 12 with the roll or rolls of stamps 15 contained therein, the label 12 is adhesively secured over the upper top end with stamp 22 attached thereto as shown in FIG. 1. The container with enclosed rolls of stamps is taken to the post office for application of the cancellation seal to the label and attached stamp in the manner shown in FIG. 1. By this procedure, authentication of the fact that all of the stamps contained in container 11 constitute original first day of issue stamps is achieved so that a person who subsequently purchases the authenticated package is assured of the fact that he or she is indeed purchasing authenticated, first day of issue stamps which have not be marred by direct application of a cancellation seal to the stamp itself insofar as those stamps contained in the roll being authenticated are concerned.

In preferred embodiments of the invention, each roll of stamps 15 to be authenticated is enclosed in an individual, relatively rigid, closed, inner container of clear plastic material 25 best shown in FIG. 3. Inner container 25 has a removable top 26 which can be removed in order to insert the roll 15 into the inner, relatively rigid plastic container 25 and the top 26 thereafter permanently secured over the inner container by clamps (not shown), adhesives or the like.

Where provided, the inner, relatively rigid plastic container 25 will protect the roll of stamps 15 being authenticated from being squashed or otherwise deformed during subsequent handling after authentication.

It is also desirable that an additional cancellation seal be provided to a second gummed label 27 adhesively secured over the removable top 26 and overlapping around the top edges 28 of the inner container 25. A second stamp 29 either taken from the roll 15 or which is another original stamp of the same issue, is adhesively secured to the top of the label 27. With this arrangement, a shortened version of a cancellation seal shown at 31 and containing only the bull's eye portion of the cancellation seal as illustrated in FIG. 4 can be applied to the top of label 27 and stamp 29. This, of course, must be applied to label 27 and stamp 29 after the roll 15 has been inserted in the inner container 25 and top 26 secured thereover together with label 27 and stamp 29, all prior to inserting the inner container 25 into the outer flexible plastic container 11 as shown in FIGS. 1 and 4 of the drawings. This practice further assures a subsequent purchaser of the authenticated package that he or she is receiving authentic, original, first day of issue stamps contained in the package.

FIG. 4 of the drawings also illustrates an embodiment of the invention somewhat different from that shown in FIG. 1. In FIG. 4, in place of the upper heat treated thermal pressure seal 24, the label 21 containing the First Day of Issue cancellation seal 16 is secured over the top edge of the outer flexible container 11 after insertion of the rolls 15 therein contained within container 25 and thereafter the top of container 11 is stapled closed by staples 32. In all other respects, the embodiment of the invention shown in FIG. 4 is similar to and functions in the same manner as that described with relation to FIG. 1 of the drawings.

COMMERCIAL APPLICATION

The invention is used in the collection and distribution for sale of authentic first day of issue postage stamps which are being marketed by the Postal System in the form of rolls. The packages of rolls of stamps after First Day of Issue authentication are distributed to stamp collectors and others having philatelic interests. This achieved without marring the appearance and thus reducing the value of the rolls of stamps being authenticated.

Having described two embodiments of a method and container for authentication of first day of issue rolls of stamps according to the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. A method for the First Day of Issue authentication of a roll of original government issue stamps which during printing are interconnected in an integral strip of individual stamps by means of perforated edge portions integrally interconnecting adjacent stamps in the roll; said method comprising:

enclosing a roll of stamps to be authenticated in an outer container;

sealing closed the container with the roll inside;

securing a printing ink sensitive label to the exterior of the closed container of sufficient length to accommodate a First Day of Issue cancellation seal including a bull's eye containing date and name of the post office performing the authentication, the First Day of Issue notice and at least a portion of the killer bar cancellation segments;

adhering a stamp removed from the roll to be authenticated, or another original stamp of the same issue, to the label in a position to be struck by at least the end of the killer bar cancellation segments whereby upon application of the First Day of Issue cancellation seal to the label at least the terminal ends of the killer bar cancellation segments of the cancellation seal impinge upon and cancel the original stamp adhered to the label secured to the exterior of the sealed container; and securing the label with adhered cancelled stamp over the end of the container which had been opened in order to insert the roll of stamps and then sealed closed in a manner to assure that the container has not been opened after closure and authentication.

2. The method for the First Day of Issue authentication of a roll of stamps according to claim 1 wherein the container includes a transparent portion through which the contents of the container can be viewed after insertion of the roll of stamps and authenticated without having to open the container.

3. The method for the First Day of Issue authentication of a roll of stamps according to claim 2 wherein the container is a transparent flexible plastic bag that can be opened and then permanently sealed closed after insertion of the roll of stamps to be authenticated.

4. The method for the First Day of Issue authentication of a roll of stamps according to claim 1 wherein there are a plurality of rolls of stamps from the same issue day inserted into the container prior to sealing it closed.

5. The method for the First Day of Issue authentication of a roll of stamps according to claim 3 wherein there are a plurality of rolls of stamps from the same issue day inserted into the container prior to sealing it closed.

6. The method for the First Day of Issue authentication of a roll of stamps according to claim 1 further including providing a roll of stamps to be authenticated which are secured within an individual, relatively rigid, closed inner container of clear plastic material for protection of the authenticated roll of stamps during subsequent handling, and thereafter inserting the inner container and enclosed roll of stamps into the first-mentioned outer container for application of the First Day of Issue cancellation seal after closing and sealing.

7. The method for the First Day of Issue authentication of a roll or stamps according to claim 3 further including providing each roll of stamps to be authenticated with an individual, relatively rigid, closed inner container of clear plastic material for protection of the authenticated roll of stamps during subsequent handling, and thereafter inserting the inner container and enclosed roll of stamps into the first-mentioned outer container for application of the First Day of Issue cancellation seal after closing and sealing.

8. The method for the First Day of Issue authentication of a roll of stamps according to claim 6 further including adhering a second stamp removed from a roll of stamps to be authenticated, or another original stamp of the same issue, onto a second label secured over a removable top of the inner container of relatively rigid clear plastic material, cancelling the second stamp with at least the bull's eye containing the date and name of the post office performing the authentication, and thereafter inserting the roll of stamps to be authenticated into the inner container and sealing it closed with the second label and attached cancelled second stamp before inserting the inner container into the outer container.

9. The method for the First Day of Issue authentication of a roll of stamps according to claim 7 further including adhering a second stamp removed from a roll of stamps to be authenticated, or another stamp of the same issue, onto a second label secured over a removable top of the inner container of relatively rigid clear plastic material, cancelling the second stamp with at least the bull's eye containing the date and name of the post office performing the authentication, and thereafter inserting the roll of stamps to be authenticated into the inner container and sealing it closed with the second label and attached cancelled second stamp before inserting the inner container into the outer container.

10. The product of the method of authentication recited in claim 1 wherein a roll of stamps to be authenticated is enclosed in an outer container that is sealed closed after insertion of the roll of stamps therein;

a printing ink sensitive label is secured over the exterior of the closed end of the outer container in a manner to assure that the container has not been opened after insertion of the roll of stamps and closure; and the label has a stamp removed from the roll, or a similar stamp of the same issue, secured to one end thereof and has stamped thereon the First Day of Issue cancellation seal including a bull's eye containing the date and name of the post office performing the authentication, the First Day of Issue notice and at least a portion of the killer bar cancellation segments, and at least the terminal ends of the killer bar cancellation segments impinge upon and cancel the stamp attached to the end of the label.

11. The product of the method of authentication recited in claim 3 wherein a roll of stamps to be authenticated is enclosed in an outer container that is sealed closed after insertion of the roll of stamps therein;

a printing ink sensitive label is secured over the exterior of the closed end of the outer container in a manner to assure that the container has not been opened after insertion of the roll of stamps and closure; and the label has a stamp removed from the roll, or a similar stamp of the same issue, secured to one end thereof and has stamped thereon the First Day of Issue cancellation seal including a bull's eye containing the date and name of the post office performing the authentication, the First Day of Issue notice and at least a portion of the killer bar cancellation segments, and at least the terminal ends of the killer bar cancellation segments impinge upon and cancel the stamp attached to the end of the label.

12. The product of the method of authentication recited in claim 5 wherein the rolls of stamps to be authenticated are enclosed in an outer clear plastic container that is sealed closed after insertion of the rolls of stamps therein;

a printing ink sensitive label is secured over the exterior of the closed end of the outer container in a manner to assure that the container has not been opened after insertion of the rolls of stamps and closure; and the label has a stamp removed from one of the rolls, or a similar stamp of the same issue, secured to one end thereof and has stamped thereon the First Day of Issue cancellation seal including a bull's eye containing the date and name of the post office performing the authentication, the First Day of Issue notice and at least a portion of the killer bar cancellation segments, and at least the terminal ends of the killer bar cancellation segments impinge upon and cancel the stamp attached to the end of the label.

13. The product of the method of authentication recited in claim 7 wherein a roll of stamps to be authenticated is enclosed in an outer clear plastic container that is sealed closed after insertion of the roll of stamps therein;

a printing ink sensitive label is secured over the exterior of the closed end of the outer container in a manner to assure that the container has not been opened after insertion of the roll of stamps and closure; and the label has a stamp removed from the roll, or a similar stamp of the same issue, secured to one end thereof and has stamped thereon the First Day of Issue cancellation seal including a bull's eye containing the date and name of the post office performing the authentication, the First Day of Issue notice and at least a portion of the killer bar cancellation segments, and at least the terminal ends of the killer bar cancellation segments impinge upon and cancel the stamp attached to the end of the label.

14. The product of the method of authentication recited in claim 9 wherein a roll of stamps to be authenticated is enclosed in an outer clear plastic container that is sealed closed after insertion of the roll of stamps therein;

a printing ink sensitive label is secured over the exterior of the closed end of the outer container in a manner to assure that the container has not been opened after insertion of the roll of stamps and closure; and the label has a stamp removed from the roll, or a similar stamp of the same issue, secured to one end thereof and has stamped thereon the First Day of Issue cancellation seal including a bull's eye containing the date and name of the post office performing the authentication, the First Day of Issue notice and at least a portion of the killer bar cancellation segments, and at least the terminal ends of the killer bar cancellation segments impinge upon and cancel the stamp attached to the end of the label.

15. A First Day of Issue authenticated roll of original government issue stamps in a package wherein each stamp in the roll is interconnected to its neighbors by perforated edge portions that integrally interconnect all of the stamps in the roll; being characterized in that:

the roll of stamps to be authenticated is enclosed in an outer flexible, clear plastic container having an open end that is sealed closed after insertion of the roll of stamps therein;

a printing ink sensitive label is secured over the exterior of the closed end of the outer container after insertion of said roll of stamps therein in a manner to assure that the container has not been opened after insertion of the roll of stamps and closure; and the label has a stamp removed from the roll, or a similar stamp of the same issue, secured to one end thereof and has stamped thereon the First Day of Issue cancellation seal including a bull's eye containing the date and name of the post office performing the authentication, the First Day of Issue notice and at least a portion of the killer bar cancellation segments, and at least the terminal ends of the killer bar cancellation segments impinge upon and cancel the stamp attached to the end of the label.

16. The First Day of Issue authenticated roll of stamps package recited in claim 15 wherein there are a plurality of rolls of stamps of the same issue day inserted into the outer container prior to sealing it closed and authenticated.

17. The First Day of Issue authenticated roll of stamps package recited in claim 15 further including a relatively rigid, closed inner container of clear plastic material into which a roll of stamps to be authenticated has been inserted prior to enclosing the roll in the flexible outer container and sealing it closed in order to better protect the roll of stamps after authentication.

18. The First Day of Issue authenticated roll of stamps package recited in claim 17 further including a second stamp removed from the roll of stamps, or another original stamp of the same issue, adhered to a second label secured over a removable top of the inner container of relatively rigid clear plastic material, the second stamp being cancelled with at least the bull's eye containing the date and name of the post office performing the authentication.

19. The First Day of Issue authenticated roll of stamps package recited in claim 18 wherein there are a plurality of individual rolls of stamps of the same issue day each enclosed in an inner container inserted into the outer container prior to sealing it closed and authenticated.

* * * * *